US009480337B2

(12) United States Patent
Xie

(10) Patent No.: US 9,480,337 B2
(45) Date of Patent: Nov. 1, 2016

(54) DISASSEMBLABLE ROCKING CHAIR WITH CONCEALED CONNECTIONS

(71) Applicant: Jianqiang Xie, Linhai (CN)

(72) Inventor: Jianqiang Xie, Linhai (CN)

(73) Assignee: Yotrio Group Co., Ltd., Linhai, Zhejian (CN)

( * ) Notice: Subject to any disclaimer, the term of this patent is extended or adjusted under 35 U.S.C. 154(b) by 216 days.

(21) Appl. No.: 14/267,827

(22) Filed: May 1, 2014

(65) Prior Publication Data

US 2015/0313363 A1 Nov. 5, 2015

(51) Int. Cl.

| | |
|---|---|
| ***A47C 3/025*** | (2006.01) |
| ***A47C 5/04*** | (2006.01) |
| ***A47C 4/02*** | (2006.01) |

(52) U.S. Cl.

CPC ..... *A47C 3/0252* (2013.01); *A47C 3/025* (2013.01); *A47C 4/02* (2013.01); *A47C 5/04* (2013.01)

(58) Field of Classification Search

USPC ..... 297/268.1, 264.1, 259.4, 440.23
See application file for complete search history.

(56) References Cited

U.S. PATENT DOCUMENTS

| | | | | | |
|---|---|---|---|---|---|
| 210,500 | A * | 12/1878 | Clough | A47C 1/03255 | 297/342 |
| 277,454 | A * | 5/1883 | Bruschke | A47C 4/02 | 297/440.23 |
| 2,464,513 | A * | 3/1949 | Johnson | A47D 1/02 | 297/152 |
| 3,233,942 | A * | 2/1966 | Creutz | A47B 85/00 | 297/118 |
| 3,301,597 | A * | 1/1967 | Bereday | A47C 4/02 | 297/440.23 |
| 3,526,433 | A * | 9/1970 | Miller | A47C 4/02 | 297/440.23 |
| 4,119,343 | A * | 10/1978 | Pentzien | A47C 3/0252 | 248/622 |
| 4,183,494 | A * | 1/1980 | Cleveland | A47C 3/0252 | 248/567 |
| 4,340,250 | A * | 7/1982 | Ward | A47C 3/0252 | 248/618 |
| 4,523,787 | A * | 6/1985 | Robinson | A47C 4/02 | 297/440.1 |
| 5,080,438 | A * | 1/1992 | Moyer | A47C 4/028 | 297/440.23 |
| 5,263,764 | A * | 11/1993 | Laughlin | A47C 4/02 | 297/218.3 |
| 5,407,250 | A * | 4/1995 | Prince | A47C 3/029 | 297/440.2 |

(Continued)

FOREIGN PATENT DOCUMENTS

CA 2770820 A1 * 9/2012

*Primary Examiner* — David E Allred
(74) *Attorney, Agent, or Firm* — Jingming Cai; SAC Attorneys LLP

(57) ABSTRACT

A disassemblable rocking chair including a back panel member, opposing armrests, a seat panel, a spring plate, and a base member is provided. The back panel member includes first connecting elements to connect to second connecting elements of the opposing armrests and to third connecting elements of the seat panel. The spring plate includes fourth connecting elements to connect to the third connecting elements of the seat panel and to fifth connecting elements of the base member. A closed region is defined below a first spindle connecting opposing sides of each opposing armrest. The seat panel includes a wall member perpendicularly connected to a front side of its horizontal seat member. A connection between the closed region on each opposing armrest, the wall member of the seat panel, and the back panel member conceals a connection between the seat panel and the base member below the seat panel.

7 Claims, 12 Drawing Sheets

(56) References Cited

U.S. PATENT DOCUMENTS 5,634,687 A * 6/1997 Gamble ..... A47D 1/004 297/338
6,241,312 B1 * 6/2001 Watts ..... A47B 3/14 297/125
6,595,592 B1 * 7/2003 Wieland ..... A47C 4/024 297/440.15
7,175,232 B2 * 2/2007 Rivera ..... A47C 3/021 248/628
7,845,727 B2 * 12/2010 LaPointe ..... A47C 1/0355 297/268.1
2010/0060057 A1 * 3/2010 Ballendat ..... A47C 7/445 297/258.1
2013/0134763 A1 * 5/2013 Koch ..... A47C 17/02 297/440.23

* cited by examiner

DISASSEMBLABLE ROCKING CHAIR WITH CONCEALED CONNECTIONS

BACKGROUND

A wide variety of leisure chairs of different designs and sizes are available in the market. Modern day chairs comprise, for example, portable chairs, reclining chairs, foldable chairs, rocking chairs, etc. The flexible connections between different parts of the chair, for example, between a back panel, armrests, a seat panel, etc., make the chair portable and foldable. Additional elements are also included during manufacture of these chairs to make the chairs more flexible. Rocking chairs typically require a large number of interconnections. The interconnections between the back panel, the armrests, the seat panel, etc., in rocking chairs are complex, evident, and aesthetically undesirable. Hence, there is a long felt but unresolved need for a rocking chair that can be disassembled and which conceals connections between at least two parts of the chair, for example, between the back panel, the armrests, the seat panel, etc.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The apparatus disclosed herein addresses the above mentioned need for a rocking chair that can be disassembled and which conceals connections between at least two parts of the disassemblable rocking chair. The disassemblable rocking chair disclosed herein comprises a back panel member, opposing armrests, a seat panel, a spring plate, and a base member. The back panel member of the disassemblable rocking chair comprises bolt holes defined on opposing lateral extensions of the back panel member. The back panel member further comprises first connecting elements configured on the opposing sides of a lower section of the back panel member and on a mid section of the back panel member.

Each of the opposing armrests of the disassemblable rocking chair is configured as a first frame comprising a first spindle horizontally connected across the opposing sides of the first frame. Each of the opposing armrests comprises an open region above the first spindle and a closed region below the first spindle. The opposing armrests comprise latch members extending outwardly from the upper edges of the opposing armrests. The latch members of the opposing armrests detachably connect to the bolt holes defined on the opposing lateral extensions of the back panel member to interlock the opposing armrests to the back panel member. Each of the opposing armrests further comprises second connecting elements positioned on a lower section of the opposing sides of the first frame and on the first spindle. The second connecting elements detachably connect the opposing armrests to the first connecting elements of the back panel member and one or more third connecting elements of the seat panel.

The seat panel of the disassemblable rocking chair comprises a horizontal seat member, for example, of a generally rectangular shape, a second spindle connecting the opposing sides of the horizontal seat member, a wall member fixedly connected perpendicular to a front side of the horizontal seat member, and a connecting piece attached to each of the opposing sides of the wall member. The seat panel further comprises the third connecting elements positioned on the second spindle proximal to the opposing ends of the second spindle, on the connecting piece, on a rear side of the horizontal seat member, and on opposing sides of the horizontal seat member. The third connecting elements detachably connect the seat panel to one or more of the first connecting elements on the back panel member, one or more of the second connecting elements on the opposing armrests, and one or more of fourth connecting elements of the spring plate. A connection between the closed region below the first spindle of each of the opposing armrests, the wall member fixedly connected to the front side of the horizontal seat member of the seat panel, and the back panel member conceals a connection between the seat panel and the base member.

The spring plate defines the fourth connecting elements positioned proximal to the opposing sides of the spring plate. The fourth connecting elements detachably connect the spring plate to one or more of the third connecting elements of the seat panel and one or more fifth connecting elements of the base member. The base member of the disassemblable rocking chair is configured as a second frame supported by leg members extending from opposing corners of the second frame. The base member comprises a third spindle connecting the opposing sides of the second frame of the base member. The base member further comprises the fifth connecting elements positioned on the third spindle proximal to the opposing ends of the third spindle. The fifth connecting elements detachably connect the base member to one or more of the fourth connecting elements of the spring plate.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a structure referenced by a numeral in a drawing carries over to the description of that structure shown by that same numeral in any subsequent drawing herein.

DETAILED DESCRIPTION OF THE INVENTION

Figure 1:
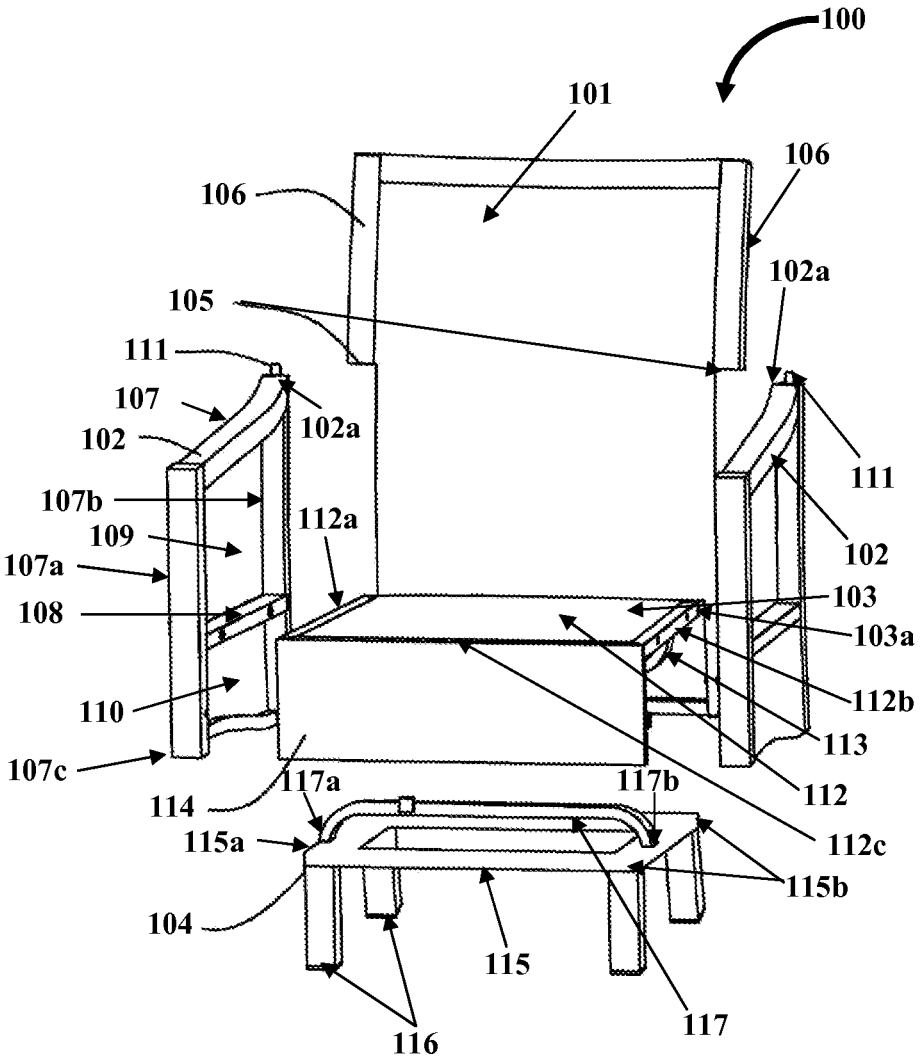
FIG. 1 exemplarily illustrates an exploded view of a disassemblable rocking chair.

FIG. 1 exemplarily illustrates an exploded view of a disassemblable rocking chair 100. The disassemblable rocking chair 100 disclosed herein comprises a back panel member 101, opposing armrests 102, a seat panel 103, and a base member 104. In an embodiment, each of the back panel member 101, the opposing armrests 102, the seat panel 103, and the base member 104 are, for example, formed by a framework of pipe members interwoven with rattan. As used herein, the term "rattan" refers to a low weight fiber with high toughness and strength obtained in strips from a stem of a plant, for example, a palm that can be woven together. In an embodiment, the pipe members are made of aluminum. The back panel member 101 of the disassemblable rocking chair 100 comprises bolt holes 105 defined on opposing lateral extensions 106 of the back panel member 101. Each of the opposing armrests 102 of the disassemblable rocking chair 100 is configured as a frame 107 comprising a first spindle 108 horizontally connected across the opposing sides 107*a* and 107*b* of the frame 107. Each of the opposing armrests 102 comprises an open region 109 above the first spindle 108 and a closed region 110 below the first spindle 108. The opposing armrests 102 comprise latch members 111 extending outwardly from the upper edges 102*a* of the opposing armrests 102. The latch members 111 detachably connect to the bolt holes 105 defined on the opposing lateral extensions 106 of the back panel member 101 to interlock the opposing armrests 102 to the back panel member 101.

The seat panel 103 of the disassemblable rocking chair 100 comprises a horizontal seat member 112, for example, of a generally rectangular shape, a second spindle 113 connecting the opposing sides 112*a* and 112*b* of the horizontal seat member 112, and a wall member 114 fixedly connected perpendicular to a front side 112*c* of the horizontal seat member 112 of the seat panel 103. A connection between the closed region 110 below the first spindle 108 of each of the opposing armrests 102, the wall member 114 fixedly connected to the front side 112*c* of the horizontal seat member 112 of the seat panel 103, and the back panel member 101 conceals a connection between the seat panel 103 and the base member 104 as disclosed in the detailed description of FIG. 2. The base member 104 of the disassemblable rocking chair 100 is configured as a frame 115 supported by leg members 116 extending from opposing corners 115*a* and 115*b* of the frame 115. In an embodiment, each of the leg members 116 supporting the base member 104 are, for example, of a generally pipe shape. The base member 104 comprises a third spindle 117 connecting the opposing sides 115*a* and 115*b* of the frame 115 of the base member 104.

Figure 2:
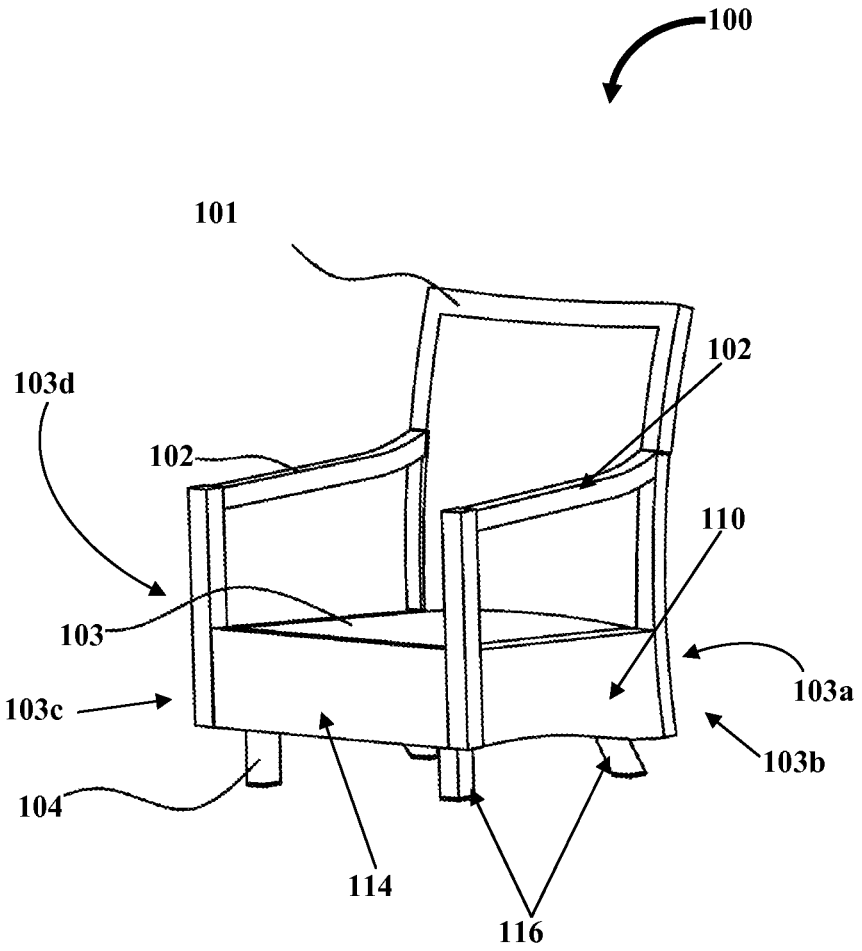
FIG. 2 exemplarily illustrates an assembled view of the disassemblable rocking chair.

FIG. 2 exemplarily illustrates an assembled view of the disassemblable rocking chair 100. As the disassemblable rocking chair 100 is assembled, the closed region 110 of each of the opposing armrests 102 exemplarily illustrated in FIG. 1, conceals the connection between the seat panel 103 and the base member 104 formed below the seat panel 103, as disclosed in the detailed description of FIGS. 10A-10B, on opposing sides 103*b* and 103*d* of the seat panel 103. The wall member 114 of the seat panel 103 conceals the connection between the seat panel 103 and the base member 104 formed below the seat panel 103 on the front side 103*c* of the seat panel 103. The back panel member 101 conceals the connection between the seat panel 103 and the base member 104 formed below the seat panel 103 on the rear side 103*a* of the seat panel 103. Therefore, the connection between the seat panel 103 and the base member 104 is concealed from all the four sides 103*a*, 103*b*, 103*c* and 103*d* of the seat panel 103. The base member 104 is inwardly positioned below the seat panel 103, as disclosed in the detailed description of FIGS. 10A-10B. When the disassemblable rocking chair 100 is viewed from a front perspective, only a portion of the leg members 116 of the base member 104 is visible to a user viewing the disassemblable rocking chair 100.

Figure 3:
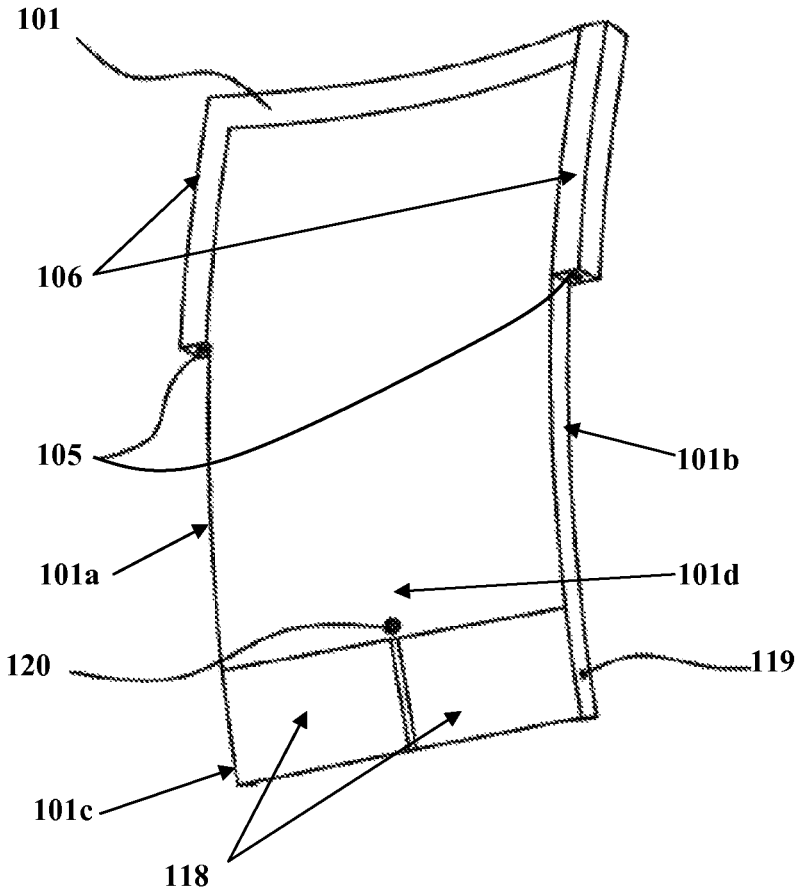
FIG. 3 exemplarily illustrates a front perspective view of a back panel member of the disassemblable rocking chair.

FIG. 3 exemplarily illustrates a front perspective view of the back panel member 101 of the disassemblable rocking chair 100 exemplarily illustrated in FIG. 1. The back panel member 101 comprises bolt holes 105 defined on the opposing lateral extensions 106 of the back panel member 101. The bolt holes 105 of the back panel member 101 are configured to receive latch members 111 of the opposing armrests 102, exemplarily illustrated in FIG. 1 and FIG. 4, to interlock the opposing armrests 102 to the back panel member 101. In an embodiment, the disassemblable rocking chair 100 disclosed herein further comprises one or more cut out portions 118 on a lower section 101*c* of the back panel member 101 for accommodating the rear side 103*a* of the horizontal seat member 112 of the seat panel 103. The back panel member 101 further comprises first connecting elements 119 and 120 configured on the opposing sides 101*a* and 101*b* of a lower section 101*c* of the back panel member 101 and on a mid section 101*d* of the back panel member 101. As used herein, "connecting elements" refers to a combination of members that can be engageably connected to each other to fasten at least two solid objects. The connecting elements comprise engageable elements, for example, nuts and bolts, bolts and connecting holes, snap fasteners, hook and eye closures, male and female connectors, etc.

As exemplarily illustrated in FIG. 3, the first connecting elements 119 and 120 of the back panel member 101 comprise, for example, back panel holes 119 defined on the opposing sides 101*a* and 101*b* of the lower section 101*c* of the back panel member 101 and a back panel bolt 120 attached to the mid section 101*d* of the back panel member 101. The back panel bolt 120 extends outwardly from the mid section 101*d* of the back panel member 101. The back panel hole 119 is configured to connect to a second armrest nut 122, exemplarily illustrated in FIG. 4, of each of the opposing armrests 102 to fasten the back panel member 101 to each of the opposing armrests 102. The back panel bolt 120 is inserted into a seat hole 128 defined on a rear side 112*d* of the horizontal seat member 112 of the seat panel 103 exemplarily illustrated in FIG. 5, to fasten the back panel member 101 to the seat panel 103.

Figure 4:
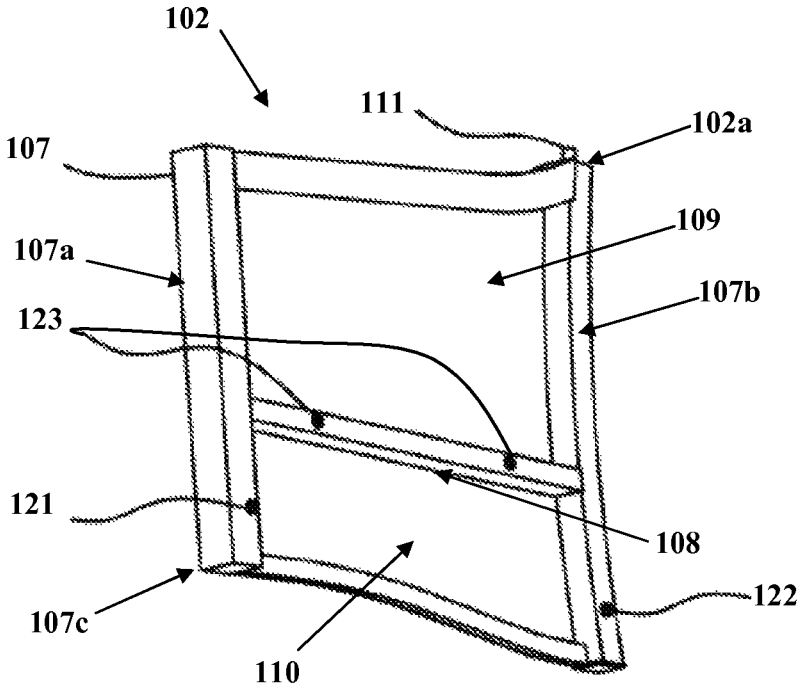
FIG. 4 exemplarily illustrates a bottom perspective view of an opposing armrest of the disassemblable rocking chair.

FIG. 4 exemplarily illustrates a bottom perspective view of an opposing armrest 102 of the disassemblable rocking chair 100 exemplarily illustrated in FIG. 1, showing the frame 107 comprising the first spindle 108, the open region 109 above the first spindle 108, and a closed region 110 below the first spindle 108 of the opposing armrest 102 as disclosed in the detailed description of FIG. 1. The latch member 111 extending outwardly from the upper edge 102*a* of the opposing armrest 102 is inserted into a corresponding bolt hole 105 on an opposing lateral extension 106 of the back panel member 101 exemplarily illustrated in FIG. 3, to interlock the opposing armrest 102 to the back panel member 101. Each of the opposing armrests 102 further comprises second connecting elements 121, 122, and 123 positioned on a lower section 107*c* of the opposing sides 107*a* and 107*b* of the frame 107 and on the first spindle 108. The second connecting elements, for example, 122 detachably connect the opposing armrests 102 to the first connecting elements 119 of the back panel member 101 exemplarily illustrated in FIG. 3, while the second connecting elements, for example, 121 and 123 detachably connect the opposing armrests 102 to the third connecting elements, for example, 127 and 129 of the seat panel 103 exemplarily illustrated in FIG. 5.

As exemplarily illustrated in FIG. 4, the second connecting elements 121, 122, and 123 of each opposing armrest 102 comprise, for example, a first armrest nut 121 and a second armrest nut 122 attached to a lower section 107*c* of the opposing sides 107*a* and 107*b* of the frame 107, and armrest bolts 123 attached to the first spindle 108. The first armrest nut 121 and the second armrest nut 122 are, for example, made of aluminum and are welded to the lower section 107*c* of the opposing sides 107*a* and 107*b* of the frame 107 of each opposing armrest 102. The first armrest nuts 121 on each of the opposing armrests 102 are inserted into seat holes 127 defined on each connecting piece 125 of the seat panel 103 exemplarily illustrated in FIG. 5 and FIGS. 6A-6B. The armrest bolts 123 are inserted into seat holes 129 defined on the opposing sides 112*a* and 112*b* of the horizontal seat member 112 of the seat panel 103 as exemplarily illustrated in FIG. 5 and FIGS. 6A-6B, to fasten the opposing armrests 102 to the seat panel 103. The second armrest nuts 122 on each of the opposing armrests 102 are inserted into the back panel holes 119 of the back panel member 101 exemplarily illustrated in FIG. 3 and FIGS. 9A-9B, to fasten the opposing armrests 102 to the back panel member 101.

Figure 5:
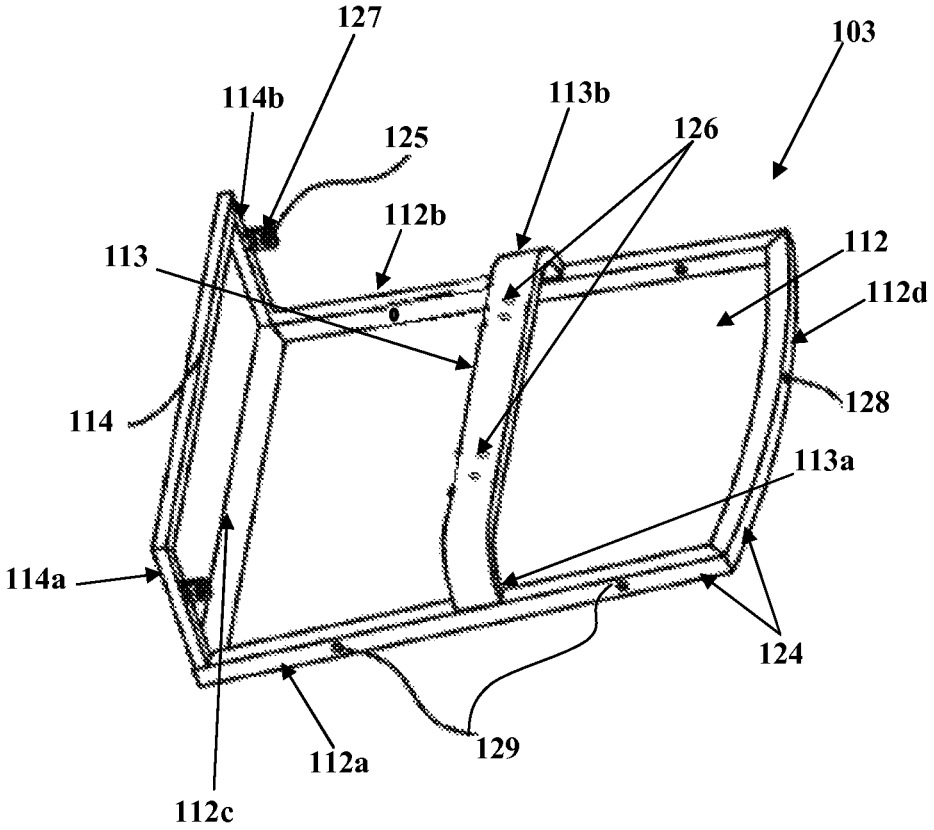
FIG. 5 exemplarily illustrates a bottom perspective view of a seat panel of the disassemblable rocking chair.

FIG. 5 exemplarily illustrates a bottom perspective of the seat panel 103 of the disassemblable rocking chair 100 exemplarily illustrated in FIG. 1, showing the horizontal seat member 112, the second spindle 113 connecting the opposing sides 112*a* and 112*b* of the horizontal seat member 112, and the wall member 114 of the seat panel 103. The seat panel 103 further comprises a connecting piece 125 attached to each of the opposing ends 114*a* and 114*b* of the wall member 114. The second spindle 113 provides a support for an apron 124 of the seat panel 103. The seat panel 103 further comprises third connecting elements 126, 127, 128, and 129 positioned on the second spindle 113 proximal to the opposing ends 113*a* and 113*b* of the second spindle 113, on the connecting piece 125, on the rear side 112*d* of the horizontal seat member 112, and on the opposing sides 112*a* and 112*b* of the horizontal seat member 112 respectively. The third connecting elements 126 detachably connect the seat panel 103 to fourth connecting elements 131 of a spring plate 130 exemplarily illustrated in FIG. 7; the third connecting elements 127 detachably connect the seat panel 103 to the second connecting elements 121 and 122 on the opposing armrests 102 exemplarily illustrated in FIG. 4; the third connecting element 128 detachably connect the seat panel 103 to the first connecting element 120 on the back panel member 101 exemplarily illustrated in FIG. 3; and the third connecting elements 129 detachably connect the seat panel 103 to the second connecting elements 123 of the opposing armrests 102 exemplarily illustrated in FIG. 4.

As exemplarily illustrated in FIG. 5, the third connecting elements 126, 127, 128, and 129 comprise first seat holes 126 defined on the second spindle 113 proximal to the opposing ends 113*a* and 113*b* of the second spindle 113, second seat holes 127 defined on each connecting piece 125, a third seat hole 128 defined on a rear side 112*d* of the horizontal seat member 112, and fourth seat holes 129 defined on the opposing sides 112*a* and 112*b* of the horizontal seat member 112. The first seat holes 126 are configured to be connected, for example, via through holes 131 defined on the spring plate 130, as exemplarily illustrated in FIG. 7, using fastening elements such as screws or elongate bolts 135 exemplarily illustrated in FIG. 10B, to fasten the seat panel 103 to the spring plate 130. Each second seat hole 127 on each connecting piece 125 receives the first armrest nut 121 on each of the opposing armrests 102 exemplarily illustrated in FIG. 4, to fasten the seat panel 103 to each opposing armrest 102. The third seat hole 128 receives the back panel bolt 120 of the back panel member 101 exemplarily illustrated in FIG. 3, to fasten the seat panel 103 to the back panel member 101. The fourth seat holes 129 receive the armrest bolts 123 of each of the opposing armrests 102 exemplarily illustrated in FIG. 4, to fasten the seat panel 103 to the opposing armrests 102.

Figure 6B:
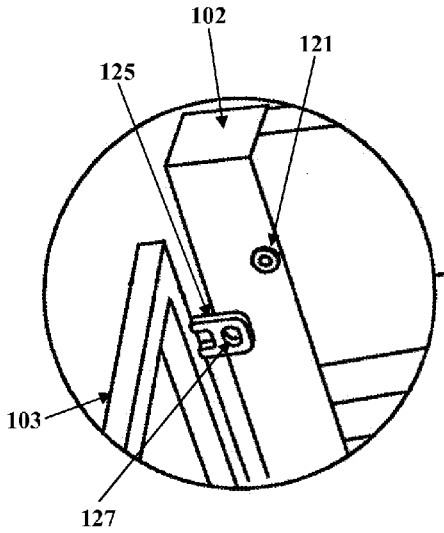
FIG. 6B exemplarily illustrates an enlarged view of a portion marked A in FIG. 6A, showing the connection between the seat panel and one of the opposing armrests.
Figure 6A:
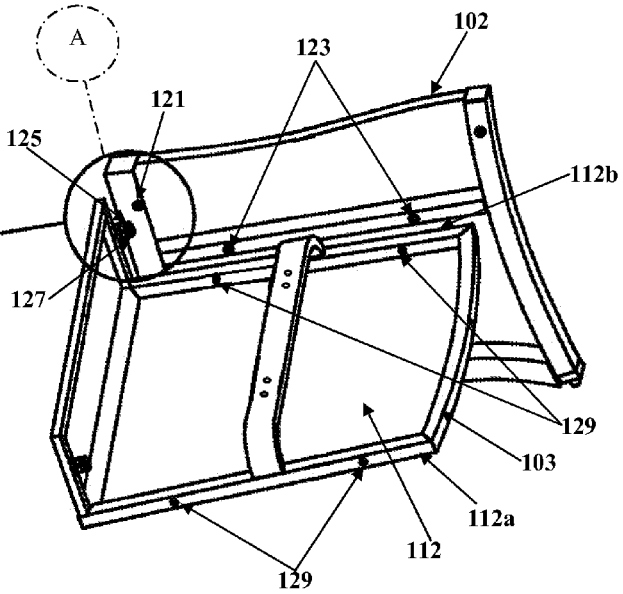
FIG. 6A exemplarily illustrates a bottom perspective view of the seat panel attached to one of the opposing armrests of the disassemblable rocking chair.

FIGS. 6A-6B exemplarily illustrate a bottom perspective of a seat panel 103 attached to one of the opposing armrests 102 of the disassemblable rocking chair 100 exemplarily illustrated in FIG. 1, and an enlarged view of a portion marked A in FIG. 6A, showing the connection between the seat panel 103 and one of the opposing armrests 102. The fourth seat holes 129 defined on the opposing sides 112*a* and 112*b* of the horizontal seat member 112 receive the armrest bolts 123 of each of the opposing armrests 102, to fasten the seat panel 103 to the each of the opposing armrests 102. As exemplarily illustrated in FIG. 6B, each second seat hole 127 on each connecting piece 125 receives the first armrest nut 121 welded on each of the opposing armrests 102 to fasten the seat panel 103 to each of the opposing armrests 102.

Figure 7:
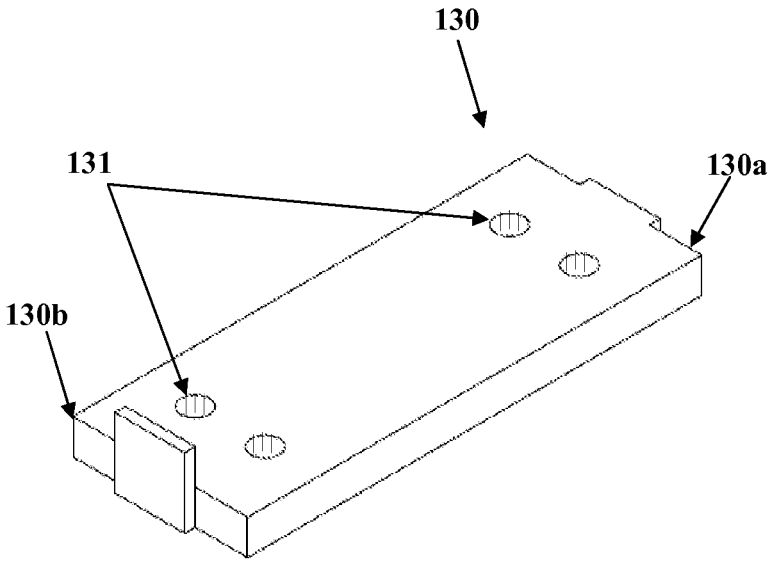
FIG. 7 exemplarily illustrates a top perspective view of a spring plate of the disassemblable rocking chair.

FIG. 7 exemplarily illustrates a top perspective of a spring plate 130 of the disassemblable rocking chair 100 exemplarily illustrated in FIG. 1. The disassemblable rocking chair 100 disclosed herein further comprises a spring plate 130. As used herein, "spring plate" refers to a spring in a flattened form which can undergo elastic deformation, or a thick strip of sheet that regains shape or position after being subjected to tension, compression or bending. The spring plate 130 comprises the fourth connecting elements 131 positioned proximal to opposing sides 130*a* and 130*b* of the spring plate 130. The fourth connecting elements 131 are, for example, through holes. The fourth connecting elements 131 detachably connect the spring plate 130 to the third connecting elements 126 of the seat panel 103 exemplarily illustrated in FIG. 5, and to fifth connecting elements 132 of the base member 104 as exemplarily illustrated in FIG. 8, as disclosed in the detailed description of FIGS. 10A-10B. The spring plate 130 is sandwiched and fastened between the seat panel 103 and the base member 104 to provide a flexible and shock absorbing connection when a user sits on the disassemblable rocking chair 100. The fourth connecting elements 131 on the spring plate 130 are configured to receive an elongate bolt 135 as exemplarily illustrated in FIG. 10B.

Figure 8:
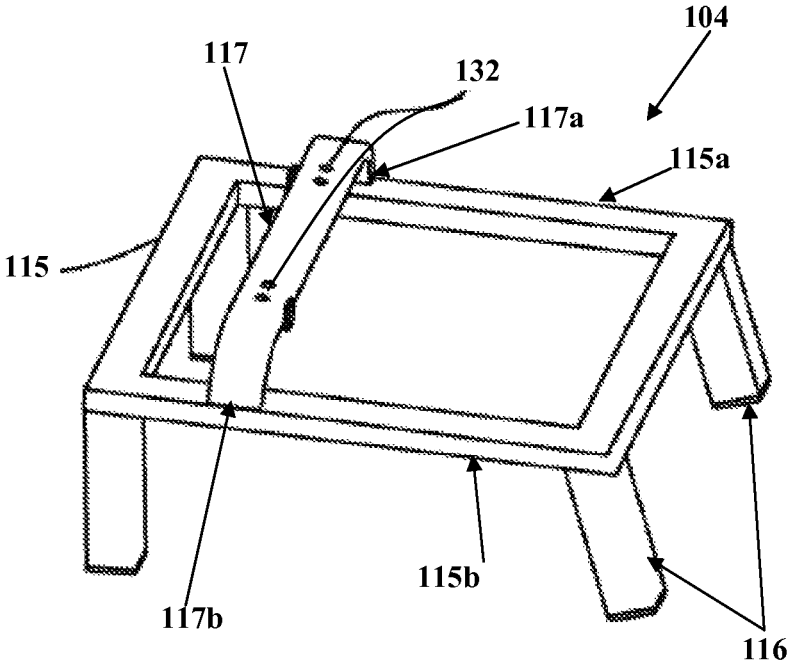
FIG. 8 exemplarily illustrates a top perspective view of a base member of the disassemblable rocking chair.

FIG. 8 exemplarily illustrates a top perspective of the base member 104 of the disassemblable rocking chair 100 exemplarily illustrated in FIG. 1, showing the frame 115, the third spindle 117, and the leg members 116 of the base member 104. The base member 104 further comprises the fifth connecting elements 132 positioned on the third spindle 117 proximal to the opposing ends 117*a* and 117*b* of the third spindle 117. The fifth connecting elements 132 are, for example, base connecting holes. The fifth connecting elements 132 detachably connect the base member 104 to the fourth connecting elements 131 of the spring plate 130 as disclosed in the detailed description of FIGS. 10A-10B.

For purposes of illustration, the first connecting elements 119 and 120 of the back panel member 101, the second connecting elements 121, 122, and 123 of the opposing armrests 102, the third connecting elements 126, 127, 128 and 129 of the seat panel 103, the fourth connecting elements 131 of the spring plate 130, and the fifth connecting elements 132 of the base member 104 are configured, for example, as bolts or connecting holes; however the scope of the disassemblable rocking chair 100 disclosed herein is not limited to connecting elements such as bolts and connecting holes, but may be extended to include any type of engageable connecting elements, for example, nuts and bolts, male and female connectors, and other functionally equivalent connecting elements to connect the different parts of the disassemblable rocking chair 100.

Figure 9A:
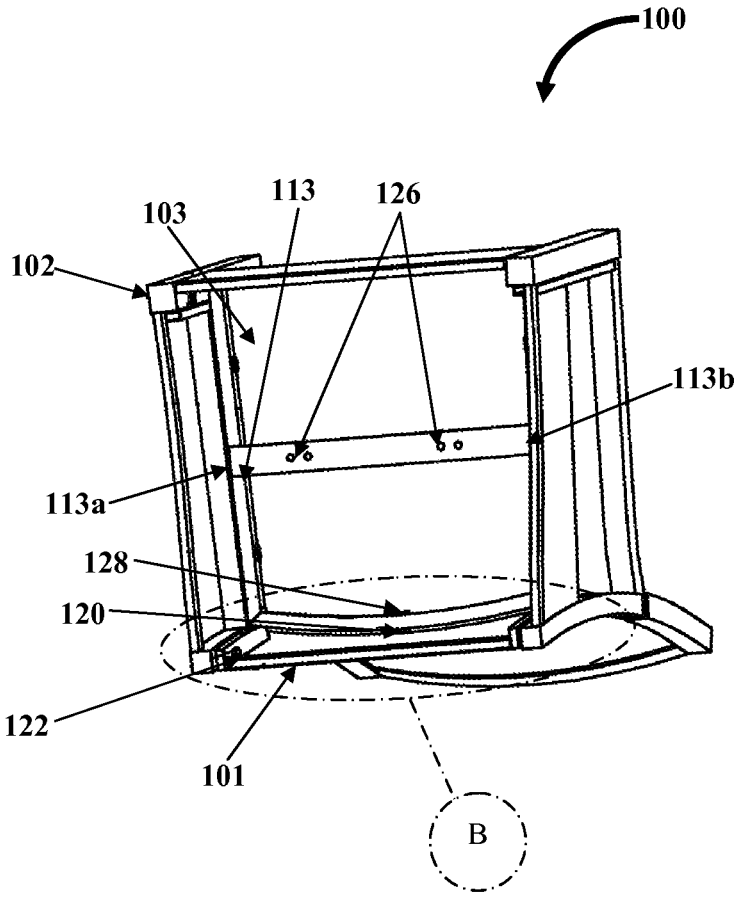
FIG. 9A exemplarily illustrates a bottom perspective view of the disassemblable rocking chair, without attachment of the base member.
Figure 9B:
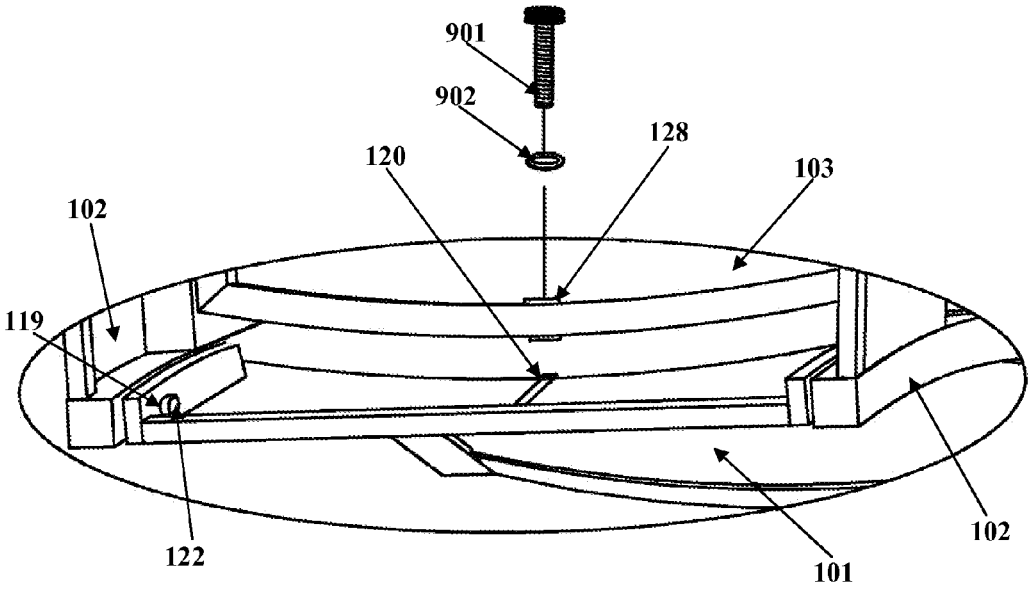
FIG. 9B exemplarily illustrates an enlarged view of a portion marked B in FIG. 9A, showing the connections between the back panel member, the opposing armrests, and seat panel.

FIGS. 9A-9B exemplarily illustrate a bottom perspective view of the disassemblable rocking chair 100, without attachment of the base member 104 exemplarily illustrated in FIG. 8, and an enlarged view of a portion marked B in FIG. 9A, showing the connections between the back panel member 101, the opposing armrests 102, and seat panel 103. Two pairs of first seat holes 126 are defined on the second spindle 113 proximal to the opposing ends 113*a* and 113*b* of the second spindle 113. As exemplarily illustrated in FIG. 9B, the back panel bolt 120 of the back panel member 101 is inserted into the third seat hole 128 of the seat panel 103 to fasten the back panel member 101 to the seat panel 103. A bolt 901 with a support washer 902 is inserted through the third seat hole 128 in a direction opposing to the direction of insertion of the back panel bolt 120 to further fasten the seat panel 103 to the back panel member 101. The back panel holes 119 receive the second armrest nut 122 of each of the opposing armrests 102 to fasten the back panel member 101 to each of the opposing armrests 102.

Figure 10A:
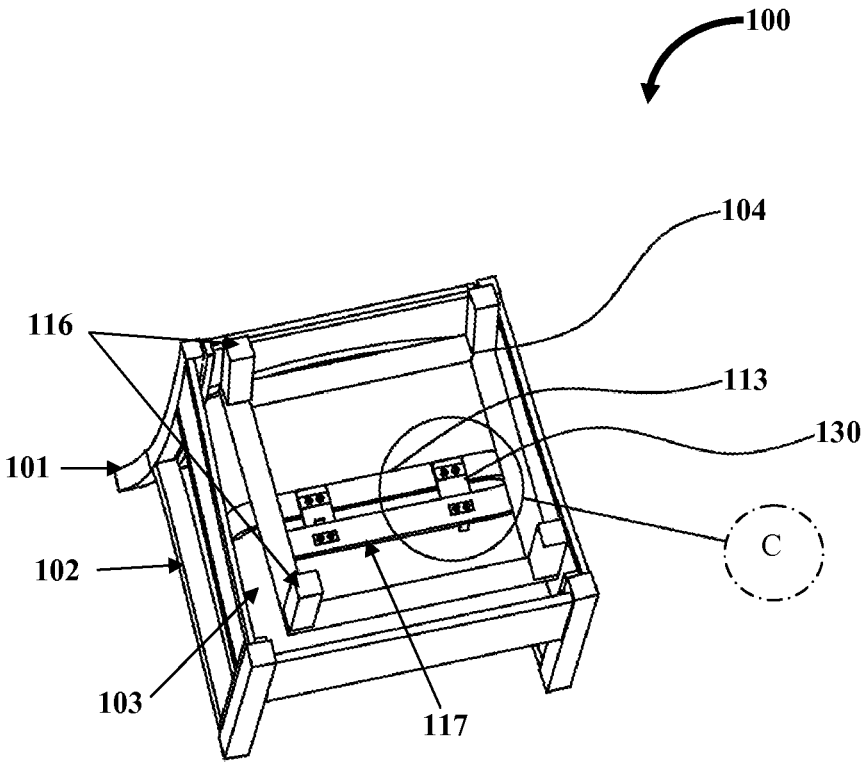
FIG. 10A exemplarily illustrates a bottom perspective view of the disassemblable rocking chair after attaching the base member to the seat panel.
Figure 10B:
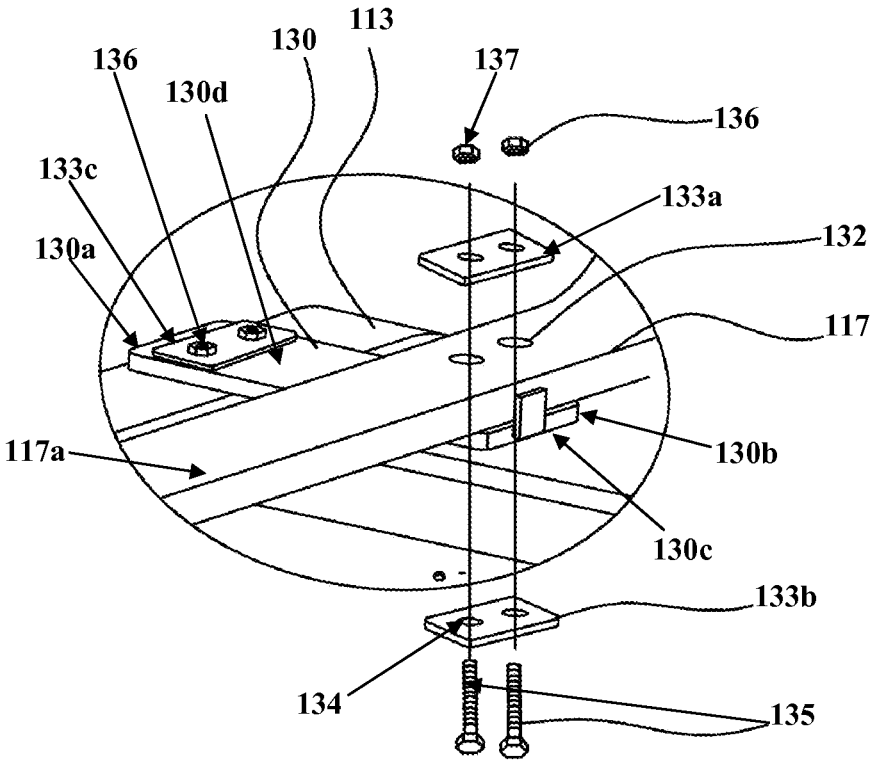
FIG. 10B exemplarily illustrates an enlarged view of a portion marked C of the disassemblable rocking chair in FIG. 10A.

FIG. 10A exemplarily illustrates a bottom perspective view of the disassemblable rocking chair 100 after attaching the base member 104 to the seat panel 103. FIG. 10B exemplarily illustrates an enlarged view of a portion marked C of the disassemblable rocking chair 100 in FIG. 10A. As exemplarily illustrated in FIG. 10A, the second spindle 113 of the seat panel 103 and the third spindle 117 of the base member 104 are parallelly displaced by the spring plate 130. The second spindle 113 and the third spindle 117 are positioned on opposing ends 130*a* and 130*b* of the spring plate 130 exemplarily illustrated in FIG. 7. As exemplarily illustrated in FIG. 10B, in an embodiment, the disassemblable rocking chair 100 disclosed herein further comprises a first intermediate element 133*a* attached an opposing surface 117*a* of the third spindle 117 and a second intermediate element 133*b* attached on an opposing surface 130*c* of the spring plate 130. Similarly, a third intermediate element 133*c* is attached over an opposing surface 130*d* of the spring plate 130 and a fourth intermediate element (not shown) is attached on an opposing surface (not shown) of the second spindle 113. The intermediate elements 133*a*, 133*b*, and 133*c* and the fourth intermediate element are, for example, pressing members made of a thin plate of metal to distribute the load at a junction of connection between a nut and a bolt.

Each of the intermediate elements 133*a*, 133*b*, and 133*c* and the fourth intermediate element comprises bore holes 134. Elongate bolts 135 are configured to be inserted through the bore holes 134 of the intermediate elements 133*a* and 133*b*, the fifth connecting elements 132 of the third spindle 117, and the fourth connecting elements 131 of the spring plate 130 as exemplarily illustrated in FIG. 7. The intermediate element 133*a* is attached by a nut 136 fastened on the elongate bolt 135 on the opposing surface 117*a* of the third spindle 117 proximal to the opposing end 130*b* of the spring plate 130. The intermediate element 133*b* is attached by the elongate bolt 135 on the opposing surface 130*c* of the spring plate 130. Similarly, another set of elongate bolts 135 is configured to be inserted through the bore holes 134 of the intermediate element 133*c* and the fourth intermediate element (not shown), the first seat holes 126 of the second spindle 113 exemplarily illustrated in FIG. 5, and the fourth connecting elements 131 of the spring plate 130 exemplarily illustrated in FIG. 7. The intermediate element 133*c* is fastened by nuts 136 on the opposing surface 130*d* of the spring plate 130 proximal to the opposing end 130*a* of the spring plate 130. The fourth intermediate element (not shown) is similarly fastened by elongate bolts 135 on the opposing surface (not shown) of the second spindle 113. In an embodiment, the nuts 132 configured to fasten the base member 104 to the seat panel 103 comprise caps 137 made of, for example, plastic.

The disassemblable rocking chair 100 exemplarily illustrated in FIG. 1, is simple, compact with a small package sized removable structure, and used for indoor and outdoor applications. The disassemblable rocking chair 100 disclosed herein comprising the back panel member 101, the opposing armrests 102, the seat panel 103, the spring plate 130, and the base member 104 are of an inserting nature, and is therefore convenient to assemble and disassemble.

The foregoing examples have been provided merely for the purpose of explanation and are in no way to be construed as limiting of the present invention disclosed herein. While the invention has been described with reference to various embodiments, it is understood that the words, which have been used herein, are words of description and illustration, rather than words of limitation. Further, although the invention has been described herein with reference to particular means, materials, and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may affect numerous modifications thereto and changes may be made without departing from the scope and spirit of the invention in its aspects.

I claim:

1. A disassemblable rocking chair, comprising:

a back panel member comprising bolt holes defined on opposing lateral extensions of said back panel member, said back panel member further comprising first connecting elements configured on opposing sides of a lower section of said back panel member and on a mid section of said back panel member;

opposing armrests, each of said opposing armrests configured as a first frame comprising a first spindle horizontally connected across opposing sides of said first frame, wherein said each of said opposing armrests comprises an open region above said first spindle and a closed region below said first spindle, said opposing armrests comprising latch members extending outwardly from upper edges of said opposing armrests, said latch members configured to detachably connect to said bolt holes defined on said opposing lateral extensions of said back panel member to interlock said opposing armrests to said back panel member, said each of said opposing armrests further comprising second connecting elements positioned on a lower section of said opposing sides of said first frame and on said first spindle, said second connecting elements configured to detachably connect said opposing armrests to one or more of said first connecting elements of said back panel member and one or more of third connecting elements of a seat panel;

said seat panel comprising a horizontal seat member, a second spindle connecting opposing sides of said horizontal seat member, a wall member fixedly connected perpendicular to a front side of said horizontal seat member, and a connecting piece attached to each of opposing sides of said wall member, said seat panel further comprising said third connecting elements positioned on said second spindle proximal to opposing ends of said second spindle, on said connecting piece, on a rear side of said horizontal seat member, and on opposing sides of said horizontal seat member, said third connecting elements configured to detachably connect said seat panel to said one or more of said first connecting elements on said back panel member, said one or more of said second connecting elements on said opposing armrests, and one or more of fourth connecting elements of a spring plate, wherein a connection between said closed region below said first spindle of each of said opposing armrests, said wall member fixedly connected to said front side of said horizontal seat member of said seat panel, and said back panel member conceals a connection between said seat panel and a base member;

said spring plate comprising said fourth connecting elements positioned proximal to opposing sides of said spring plate, said fourth connecting elements configured to detachably connect said spring plate to said one or more of said third connecting elements of said seat panel and one or more of fifth connecting elements of said base member; and said base member configured as a second frame supported by leg members extending from opposing corners of said second frame, said base member comprising a third spindle connecting opposing sides of said second frame of said base member, said base member further comprising said fifth connecting elements positioned on said third spindle proximal to opposing ends of said third spindle, said fifth connecting elements configured to detachably connect said base member to said one or more of said fourth connecting elements of said spring plate; wherein each of the lower section of the back panel member, the closed region of the opposing armrests, and the wall member of the seat panel extends below the spring plate and together substantially surround at least an upper portion of the base member such that the spring plate, second spindle, and third spindle remain hidden from view during use.

2. The disassemblable rocking chair of claim 1, wherein said first connecting elements of said back panel member, said second connecting elements of said opposing armrests, said third connecting elements of said seat panel, said fourth connecting elements of said spring plate, and said fifth connecting elements of said base member comprise one or more of bolts and connecting holes.

3. The disassemblable rocking chair of claim 1, further comprising one or more cut out portions on said lower section of said back panel member, wherein said one or more cut out portions are configured to accommodate a rear side of said horizontal seat member of said seat panel.

4. The disassemblable rocking chair of claim 1, wherein said spring plate is configured to be sandwiched and fastened between said seat panel and said base member.

5. The disassemblable rocking chair of claim 1, wherein each of said back panel member, said opposing armrests, said seat panel, and said base member are formed by a framework of pipe members interwoven with rattan.

6. The disassemblable rocking chair of claim 5, wherein said pipe members are made of aluminum.

7. The disassemblable rocking chair of claim 1, wherein each of said leg members supporting said base member are of a generally pipe shape.

* * * * *